United States Patent [19]

Gainey

[11] Patent Number: 4,494,787

[45] Date of Patent: Jan. 22, 1985

[54] FOLDABLE SKI AND POLE CARRIER

[76] Inventor: Michael D. Gainey, 2620 Del Monte La., Reno, Nev. 89511

[21] Appl. No.: 517,146

[22] Filed: Jul. 25, 1983

[51] Int. Cl.[3] ..... B65D 71/00

[52] U.S. Cl. ..... 294/147; 280/814; 224/917

[58] Field of Search ..... 294/147, 3, 16, 26; 224/917; 280/814, 815; 211/605 K; 24/815 K

[56] References Cited

U.S. PATENT DOCUMENTS

| | | | |
|---|---|---|---|
| 3,257,054 | 6/1966 | Miesel | 294/147 |
| 4,165,027 | 8/1979 | Briggs | 294/147 |
| 4,326,747 | 4/1982 | Finnegan | 294/147 |

*Primary Examiner*—James B. Marbert

*Attorney, Agent, or Firm*—Townsend and Townsend

[57] ABSTRACT

A ski and pole carrier unit adapted to be used in pairs to secure the skis and poles together is disclosed. Each unit includes a flat rectangular block with a pair of slots projecting inwardly from the long sides of the block and slightly toward one of the short sides. The width of each slot is sufficient to accommodate a ski pole. An L-shaped member is pivotably attached to the block proximate the other of the short sides and foldable from a position flush with two sides of the block to a position extended from the block. In the extended position, the base of the L-shaped member is parallel to the short side of the block and defines a space for receiving a pair of skis in the plane of the poles. A pair of straps are attached to the block, one strap to secure the poles to the slots and the other strap to secure the skis to the L-shaped member. The skis and poles are secured in a common plane by a pair of the units, so that they can easily be carried as a package.

7 Claims, 11 Drawing Figures

FOLDABLE SKI AND POLE CARRIER

The present invention relates to a ski and pole carrier for binding the skis and poles together for convenient carrying by the user.

As is well known by anyone who has ever skied, skies and poles are heavy and unwieldly, and they refuse to stay together in a convenient bundle when one attempts to carry them to and from the ski slopes. This is a particular problem for women and young children, and is exacerbated by the fact that the skier is usually wearing gloves, clumsy boots and is carrying other equipment.

A number of devices have been developed for the avowed purpose of making it easier for the skier to carry his skis and poles to and from the ski slopes. Examples of such devices are found in U.S. Pat. No. 3,260,430 to Sandenburg; U.S. Pat. No. 3,737,956 to Gragert; U.S. Pat. No. 3,626,553 to Darney et al.; U.S. Pat. No. 3,225,987 to Bonner; and U.S. Pat. No. 4,165,027 to Briggs. However, with the exception of the patent to Briggs, the devices depicted are generally too large and bulky to be conveniently carried on the person of the skier. Because the skier has no convenient place to leave them while skiing, they are impractical. Moreover, the devices illustrated in the subject patents, except for the Bonner device, which is quite large and bulky, must be removed to put the skis and poles in a conventional ski rack.

SUMMARY OF THE INVENTION

The present invention provides a ski and pole carrier unit adapted to be used in pairs to secure the skis and poles together. Each unit includes a flat rectangular block with a pair of slots projecting inwardly from the long sides of the block and slightly toward one of the short sides. The width of each slot is sufficient to accommodate a ski pole. An L-shaped member is pivotably attached to the block proximate the other of the short sides and foldable from a position flush with two sides of the block to a position extended from the block. In the extended position, the base of the L-shaped member is parallel to the short side of the block and defines a space for receiving a pair of skis in the plane of the poles. A pair of straps are attached to the block, one strap to secure the poles to the slots and the other strap to secure the skis to the L-shaped member. The skis and poles are secured in a common plane by a pair of the units, so that they can easily be carried as a package.

In the folded configuration, the carrier units of the present invention are no larger than a package of king-sized cigarettes, and the units can easily be carried in the skier's pocket. Thus, storage of the device while skiing is not a problem. When unfolded and attached to the skis and poles, the skis and poles are rigidly secured together in a common plane. Thus, the skis and poles can easily be carried as a package by grasping the poles, and moreover, because the skis and poles are in a common plane, they can be attached to almost any kind of ski rack without removing the carrier units. The carriers of the present invention have an added advantage in connection with many types of rear-mounted ski racks, which are designed to hold the skis but not the poles, because when the skis are inserted in this type of rack and the carrier units left on, the poles will also be secured to the rack and need not be stowed elsewhere in the vehicle.

The novel features which are characteristic of the invention, as to organization and method of operation, together with further objects and advantages thereof will be better understood from the following description considered in connection with the accompanying drawings in which the preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
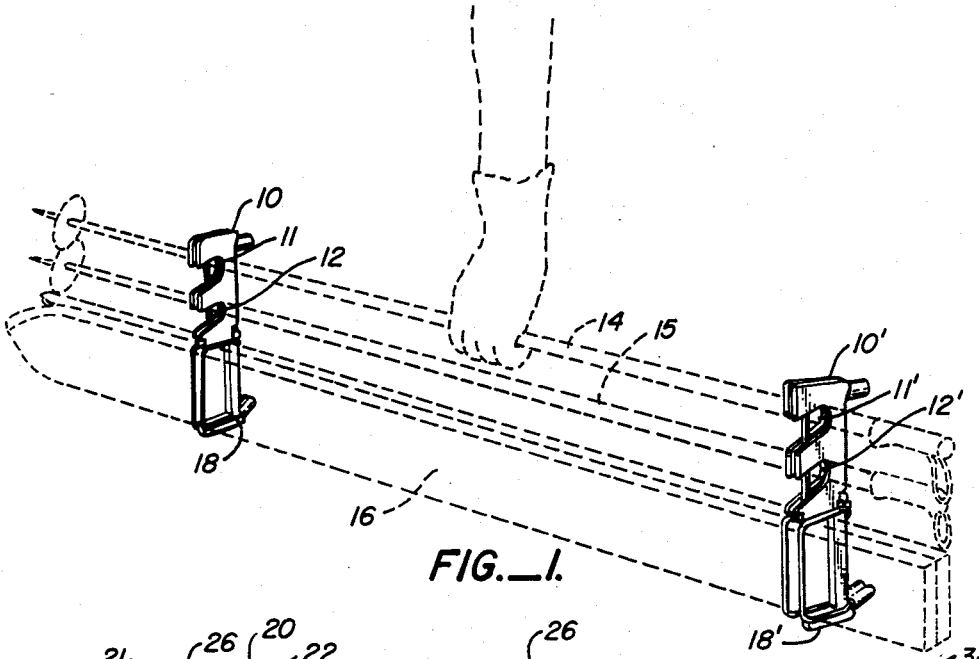
FIG. 1 is a perspective view showing the use of one of the preferred embodiments of the present invention for carrying a pair of skis and poles.

The carrier units of the present invention are adapted to be used in pairs for the carrying of ski racks and poles. As illustrated in FIG. 1, a pair 10, 10' of such carrier units have been unfolded, as will be discussed in more detail hereinafter. The carrier units have a pair of slots 11, 12 in which the ski poles 14, 15 are mounted. A pair of skis 16 are mounted on an L-shaped bracket 18 forming part of the carrier 10. The skis and poles are thus joined to one another and to carriers 10, 10' so that they can easily be carried by the skier, as illustrated.

Figure 2:
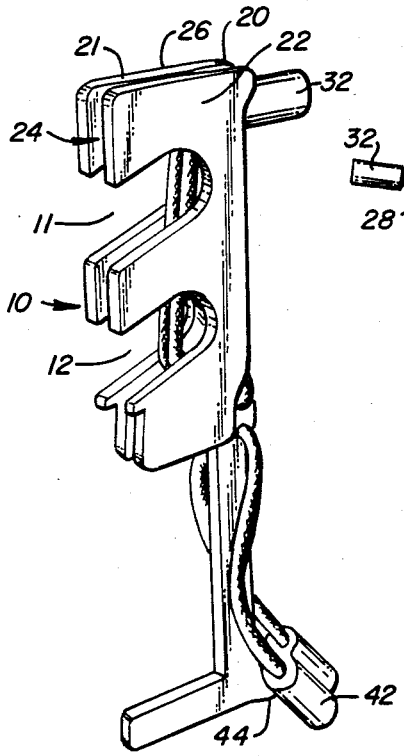
FIG. 2 is a perspective view of the embodiment of FIG. 1.

The preferred embodiment 10 of the present invention is illustrated in more detail by reference to FIGS. 2–4. Carrier unit 10 includes a block 20, which has a rectangular configuration, with two relatively long sides and two short sides. The block is preferably constructed of plastic, and includes a pair of side plates 21, 22 joined along one of the longer edges. This construction provides a groove or opening 24 along the unjoined longer edge. Slots 11, 12 are formed in plates 21, 22 of block 20. Slots 11, 12 open inwardly from the longer edge of block 20 containing opening 24, and are directed slightly toward upper short edge 26 of the block.

Figure 3A:
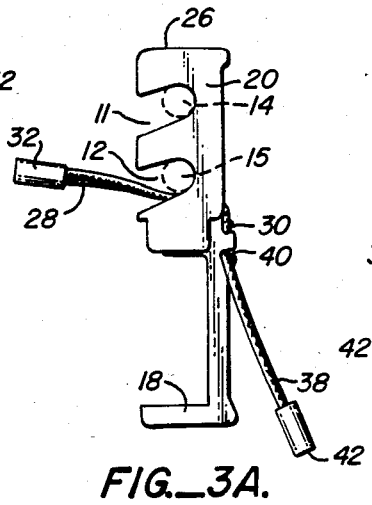
FIGS. 3A, B and C are a sequence of views illustrating the attachment of the skis and poles to the embodiment of FIG. 1.
Figure 4:
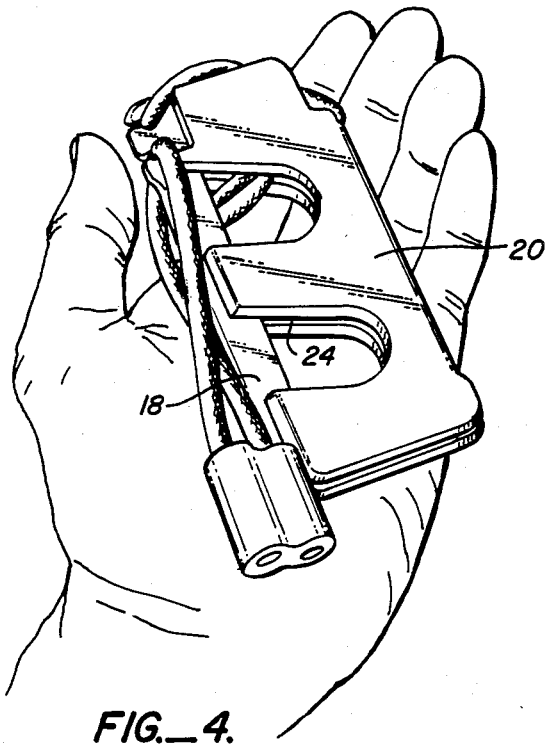
FIG. 4 is a perspective view of the embodiment of FIG. 1 in its folded configuration.

Ski poles 14, 15 are inserted in slots 11, 12 as illustrated in FIG. 3A. Because the slots are directed slightly toward upper edge 26 of block 20 the ski poles will tend to stay in the slots while they are being used to carry the skis (see FIG. 1). However, to maintain the ski poles in the slots when upward pressure is not being maintained on them, a retaining strap 28 is provided, which is anchored at 30 to the upper portion of L-shaped bracket 18. Strap 28 is highly flexible, such as a bungie cord, and its free end terminates in a peg 32. To secure ski poles 14, 15 in slots 11, 12 strap 28 is stretched in opening 24 around the ski poles, and peg 32 is pulled past a stop 34 on block 20.

Figure 3B:
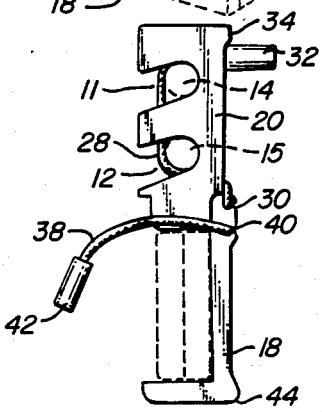
Figure 3C:
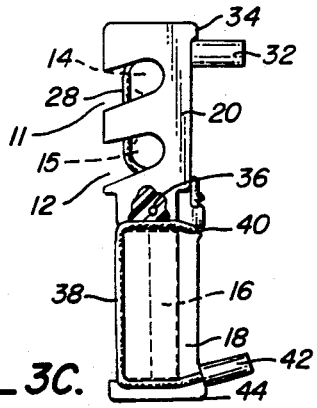

L-shaped member 18 pivots about an interior pin 36 (see FIG. 3C) to the downwardly extended position illustrated in FIG. 3B for carrying skis 16. The base of L-shaped member 18 is sufficiently spaced from the lower short edge of block 20 to accommodate the pair of skis. A second flexible strap 38 is provided which is anchored at the top of L-shaped member 18 at point 40. Strap 38 consists of a pair of strap members terminating in a dual peg 42, as best illustrated in FIG. 2. With skis 16 in position, strap 38 is stretched over the skis until peg 42 passes below the skis and around the base of L-shaped member 18, past raised projection 44. Projection 44 prevents peg 42 from being dislodged until desired, and skis 16 are secured to carrier unit 10.

When the skier has carried his skis and poles to the slope and is ready to ski, each carrier unit 10 can be readily folded for storage. L-shaped member 18 is pivoted about pin 36 (FIG. 3C) until it fits within opening 24 along one of the large and one of the short edges of block 20. As illustrated in FIG. 4, the exterior dimensions of the device are quite small in this configuration, approximately the size of a king-sized package of cigarettes. Thus, it is a simple matter to place the pair of devices in the skier's pocket for storage while skiing.

Figure 5:
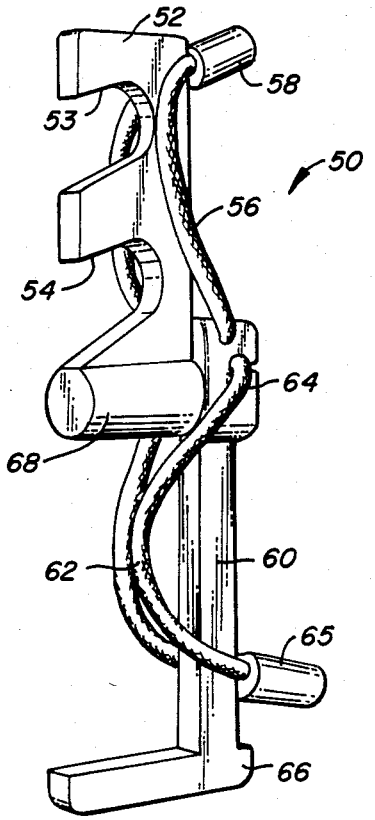
FIG. 5 is a perspective view of a second embodiment of the present invention.
Figure 6:
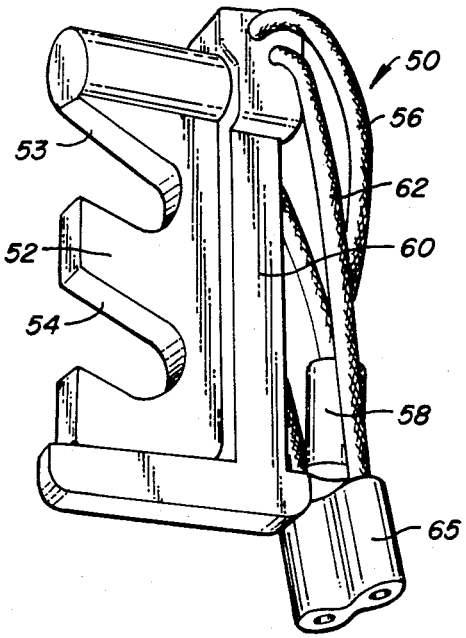
FIG. 6 is a perspective view of the embodiment of FIG. 5 in its folded configuration.
Figure 7:
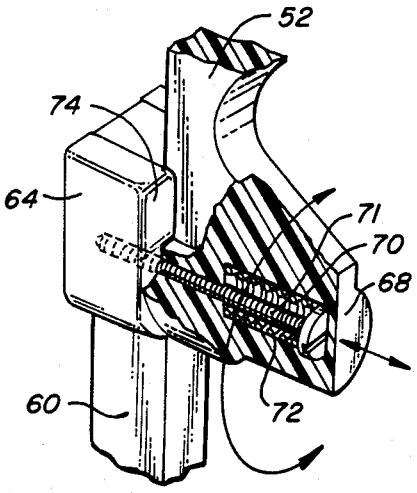
FIG. 7 is a fragmentary perspective view with portions cut away depicting the pivot mechanism of the embodiment of FIG. 5.

A second embodiment 50 of the present invention is illustrated by way of reference to FIGS. 5–7. In this embodiment, a solid block 52, preferably plastic, has a pair of slots 53, 54 formed in the same manner as those in the first embodiment to accommodate a pair of ski poles. A double strap 56 with dual peg 58 at the end passes around the poles in slots 53, 54 to secure the poles to the carrier unit.

An L-shaped member 60 pivots from a folded configuration (FIG. 6) to an unfolded configuration (FIG. 5) for carrying the skis. Strap 62, anchored at the upper end 64 of L-shaped member 60, passes around the skis past stop 66, to hold the skis in position for carrying as illustrated in FIG. 1.

The lower edge 68 of block 52 is enlarged, and has a hollow chamber 70 as illustrated in FIG. 7. A pin 71 is located in chamber 70, and is fixed to the upper portion 64 of L-shaped member 60. A spring 72 biases block 52 against L-shaped member 60. Upper portion 64 has raised abutments 74 which hold L-shaped member 60 in position when its in its extended configuration. To fold L-shaped member 60, it is pulled away from block 52 against spring 72, until it clears raised projections 74, at which point it can be rotated to its folded configuration, as illustrated in FIG. 6. In this configuration, it can be conveniently carried on the person of the skier until needed again.

Figure 8:
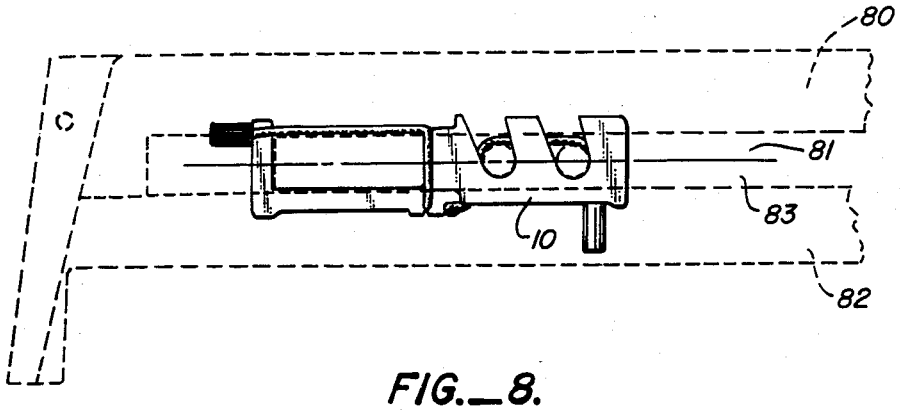
FIG. 8 is an end view illustrating the use of the embodiment of FIG. 1 in a conventional car top ski rack.

In FIG. 8, a pair of skis and poles are shown attached to a conventional car-top ski carrier. The car-top carrier illustrated includes a pair of members 80, 82 with rubber pads 81, 83 attached which act in a clamp fashion to secure the skis and poles to the car. In this type of rack, the skis and poles are all maintained in a common plane. With the apparatus of the present invention, including first embodiment 10 as illustrated but equally with the second embodiment, ski poles 14, 15 and skis 16 are all maintained in a common plane. As a result, the skis and poles can be secured to the roof-top ski rack illustrated in FIG. 8 without removing the carrier units.

Figure 9:
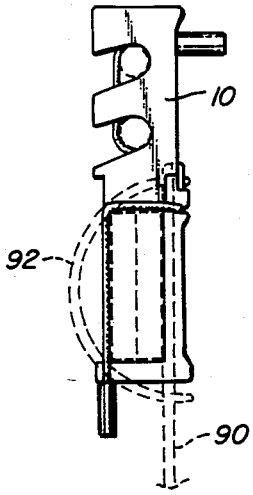
FIG. 9 is an end view of the use of the embodiment of FIG. 1 in a conventional rear-mounted ski rack.

FIG. 9 illustrates the use of the first embodiment 10 of the carrier unit of the present invention in attaching skis and poles to a conventional rear carrier rack. Such racks typically include a vertical post 90, and a flexible strap 92 for securing the skis to vertical poles 90. The skis are also supported by a base plate which is out of the plane of the figure. Such racks are not designed to carry the poles also, but when the ski carrier 10 of the present invention is employed, attachment of the skis to the ski rack attaches the poles as well. As a result, the use of such ski racks is expanded to carry the poles, and again the user need not remove the carrier unit of the present invention except while actually skiing.

In operation, the skier utilizes a pair of the carrier units of the present invention, either embodiment 10 or embodiment 50, to secure the skis and poles to one another. In this configuration, the skis and poles can easily be transported by grasping one or both of the poles. When ready to ski, the skier detaches the skis and poles from the carrier unit, which fold into a small convenient package for carrying on the person of the skier. At the end of the day, the skier can reinsert the skis and poles in the carrier, carry them back to his vehicle, and insert them in his ski rack without removing the carrier units, which can be left on until the next skiing day.

While preferred embodiments of the present invention have been illustrated in detail, it is apparent that modifications and adaptations of those embodiments will occur to those skilled in the art. However, it is to be expressly understood that such modifications and adaptations are within the spirit and scope of the present invention, as set forth in the following claims.

I claim:

1. A ski and pole carrier unit adapted to be used to secure the skis and poles together, said unit comprising:

a flat rectangular block having a pair of slots projecting inwardly from the long sides of the block and slightly toward one of the short sides, the width of each slot being sufficient to accommodate a ski pole;

an L-shaped member pivotably attached to the block proximate the other of the short sides and foldable from a position flush with two sides of the block to a position extended from the block so that the base of the L-shaped member is parallel to said other short side and defines a space for receiving a pair of skis in the plane of the poles so that the skis and poles are coplanar; and a pair of straps attached to the block, one strap adapted to secure the poles to the slots and the other strap adapted to secure the skis to the L-shaped member, whereby the skis and poles are secured in a common plane by a pair of the units to facilitate carrying of the skis and poles and attachment of the skis and poles to a ski rack without removing the carrier units, the carrier units being removed from the skis and poles during skiing and being sufficiently small when folded to fit in the skier's pocket.

2. The carrier unit of claim 1 wherein the straps are resilient, and wherein the block and the L-shaped member each contain a ridge over which the respective straps are stretched to secure the skis and poles to the unit.

3. The carrier unit of claim 1 wherein the L-shaped member is attached to the block by a pin connection perpendicular to the plane of the block so that the L-shaped member pivots in the plane of the block.

4. The carrier unit of claim 1 wherein the L-shaped member is pivotably attached to the block by a pin connection in the plane of the block, and the L-shaped member pivots in a plane perpendicular to the plane of the block.

5. The carrier unit of claim 1 wherein the block includes a pair of rectangular plates joined along one of their longer sides, and opening at their shorter sides and other longer side, and wherein the L-shaped member folds within said opening.

6. A ski and pole carrier unit adapted to be used to secure the skis and poles together, said unit comprising:

a pair of spaced rectangular plates joined along one of their longer sides and open at their shorter sides and other longer side, the plates having pairs of aligned slots projecting inwardly from the long sides of the plates and slightly toward one of the short sides, the width of each slot being sufficient to accommodate a ski pole;

an L-shaped member pivotably attached to the plates proximate the other of the short sides by a pin connection perpendicular to the plane of the plates so that the L-shaped member pivots parallel in the planes of the plates, the L-shaped member being foldable from a position within the opening of said rectangular plates to a position extended from the plates so that the base of the L-shaped member is parallel to said other short side and defines a space for receiving a pair of skis in the plane of the poles so that the skis and poles are coplanar; and a pair of resilient straps attached to the plates, one strap adapted to secure the poles to the slots and the other strap adapted to secure the skis to the L-shaped member, whereby the skis and poles are secured in a common plane by a pair of the units to facilitate carrying of the skis and poles and attachment of the skis and poles to a ski rack without removing the carrier units, the carrier units being removed from the skis and poles during skiing and being sufficiently small when folded to fit in the skier's pocket.

7. The carrier unit of claim 6 wherein the plates are constructed of a hard plastic material.

* * * * *